US008207993B2

(12) United States Patent
Kim

(10) Patent No.: US 8,207,993 B2
(45) Date of Patent: Jun. 26, 2012

(54) DISPLAY DRIVER AND DISPLAY DRIVING METHOD FOR PROCESSING GRAY-LEVEL COMPENSATION

(75) Inventor: Do-kyung Kim, Yongin-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 1162 days.

(21) Appl. No.: 12/014,897

(22) Filed: Jan. 16, 2008

(65) Prior Publication Data

US 2008/0170087 A1 Jul. 17, 2008

(30) Foreign Application Priority Data

Jan. 17, 2007 (KR) ..... 10-2007-0005437
Apr. 13, 2007 (KR) ..... 10-2007-0036622

(51) Int. Cl.
*G09G 5/10* (2006.01)

(52) U.S. Cl. ..... 345/690; 345/213; 345/89

(58) Field of Classification Search ..... 345/690, 345/213, 89
See application file for complete search history.

(56) References Cited

U.S. PATENT DOCUMENTS 6,335,720 B1 1/2002 Mori et al.
7,880,712 B2 * 2/2011 Lee ..... 345/99
2008/0001880 A1 * 1/2008 Ki-Min et al. ..... 345/89

FOREIGN PATENT DOCUMENTS

JP 07-261703 10/1995
KR 1020030027303 A 4/2003
KR 1020030065816 A 8/2003

* cited by examiner

*Primary Examiner* — Alexander Eisen
*Assistant Examiner* — Robin Mishler
(74) *Attorney, Agent, or Firm* — Volentine & Whitt, PLLC

(57) ABSTRACT

A display driver and display driving method process display data received from a central processing unit (CPU) and output display data voltages. The display driver includes a synchronization controller that sends a reference synchronization signal to the CPU, and controls the CPU to synchronize a write clock with the reference synchronization signal and to send the write clock. A write clock detector detects whether the write clock is received from the CPU and outputs a selection signal in response. A frame memory receives and stores display data of a current frame synchronized with the write clock. A gray-level compensator generates gray-level compensated display data based on the display data of a current frame and display data of a previous frame previously stored in the frame memory. A selector outputs one of the gray-level compensated display data or the display data previously stored in the frame memory as scan data in response to the selection signal.

19 Claims, 8 Drawing Sheets

DISPLAY DRIVER AND DISPLAY DRIVING METHOD FOR PROCESSING GRAY-LEVEL COMPENSATION

CROSS-REFERENCE TO RELATED PATENT APPLICATION

A claim of priority is made to Korean Patent Application No. 10-2007-0005437, filed on Jan. 17, 2007, and Korean Patent Application No. 10-2007-0036622, filed on Apr. 13, 2007, the subject matters of which are hereby incorporated by reference.

BACKGROUND OF THE INVENTION

1. Field of the Invention

The present invention generally relates to a display driver and a display driving method, and more particularly, to a display driver and a display driving method for selectively processing gray-level compensation of data synchronized with a write clock.

2. Description of the Related Art

Liquid crystal display (LCD) devices do not properly display fast video data due to a slow response speed of liquid crystal. More particularly, when LCD devices display fast video data, since the response speed of liquid crystal is not greater than a variation speed of display data voltages applied to both ends of a liquid crystal display, LCD devices fail to obtain good video quality. Accordingly, various kinds of over-driving and under-driving technologies for processing gray-level compensation have been suggested. For example, gray-level compensation processing technologies, such as response time acceleration (RTA), dynamic capacitance compensation (DCC), etc., are used by display drivers having a synchronous interface (discussed below) to compare display data of a current frame with display data of a previous frame, to compensate display data voltages according to the comparison results, and to apply the compensated display data voltages to a liquid crystal display to accelerate the response time of the liquid crystal.

Display drivers receive display data and generate display data voltages using a synchronous interface, such as an RGB interface, and an asynchronous interface, such as a central processing unit (CPU) interface.

FIG. 1A is a block diagram illustrating a conventional synchronous interface, and FIG. 1B is a timing diagram of display data DATA and display data voltages V_display illustrated in FIG. 1A.

Referring to FIG. 1A, a CPU, an application processor 110, and a display driver 120 are used in a synchronous interface type. The CPU outputs a control command CMD. The application processor 110 synchronizes the display data DATA with synchronous signals SYNC, such as horizontal synchronous signals HSYNC, vertical synchronous signals VSYNC, data write clock signals DOTCLK and the like, and transmits the synchronized display data DATA to the display driver 120. The display driver 120 generates the synchronized display data voltages V_display based on the display data DATA. The display driver 120 can include a frame memory (not shown) and a gray-level compensator (not shown) to compensate for gray-levels of the display data voltages V_display and output the compensated display data voltages V_display.

Referring to FIG. 1B, the application processor 110 transmits the synchronized display data DATA: A, B, C, D, E and F to the display driver 120 in each frame. The display driver 120 outputs the compensated display data voltages V_display corresponding to the synchronized display data DATA, such that DATA: A is output in frame n frame, DATA: B is output in frame n+1, . . . , and DATA: F is output in an frame n+5.

FIG. 2A is a block diagram illustrating a conventional asynchronous interface type, and FIG. 2B is a timing diagram of display data DATA_write and display data voltages V_display illustrated in FIG. 2A.

Referring to FIG. 2A, a CPU and a display driver 230, including a frame memory 233 and a scan driver 236, are used in the asynchronous interface type. The CPU transmits asynchronous signals ASYNC, such as write indicating signal WRB, data command determination signals RS, etc., and display data DATA to the display driver 230. Asynchronous display data DATA_write is written to the frame memory 233. The display data DATA_write is output as scan data DATA_Scan from the frame memory 233. The scan driver 236 outputs display data voltages V_display corresponding to the scan data DATA_Scan.

Referring to FIG. 2B, the CPU randomly transmits display data DATA_Write: A, B, C and D to the display driver 230 without timing limitations. More particularly, the display data DATA are transmitted from the CPU to the display driver 230 in some frames, but not in other (oblique line) frames. In the frames in which the display data DATA are not transmitted from the CPU to the display driver 230, the scan driver 236 redundantly outputs the display data voltages V_display corresponding to display data stored in the frame memory 233. Therefore, as shown in FIG. 2B, the display driver 230 outputs the display data voltages V_display corresponding to the display data DATA_Write: A in $n^{th}$ through $n+2^{nd}$ frames, outputs the display data voltages V_display corresponding to the display data DATA_Write: B in an $n+3^{rd}$ frame, outputs the display data voltages V_display corresponding to the display data DATA_Write: C in $n+4^{th}$ through $n+8^{th}$ frames, and outputs the display data voltages V_display corresponding to the display data DATA_Write: D in an $n+9^{th}$ frame.

A frame T230 illustrated in FIG. 2B will now be described in detail with reference to FIG. 2C.

FIG. 2C is a timing diagram of a write indicating signal WRB, the display data DATA_Write, and the display data voltages V_display of the frame T230. Referring to FIG. 2C, the write indicating signal WRB is a signal indicating that the CPU sends the display data DATA to the display driver 230. A frame in which a write clock WCK is transmitted corresponds to a frame in which the display data DATA are transmitted. A frame in which the write indicating signal WRB maintains a predetermined level (e.g., a high level or a low level) corresponds to a frame in which the write clock WCK is not transmitted. The display data DATA_Write: WL1, WL2, WL3, . . . , WL(m−1), WLm, is written to the frame memory 233 in the frame in which the write clock WCK is transmitted.

When a frame includes m lines, WL1 is a first line of the display data DATA_Write written to the frame memory 233, WL2 is a second line of the display data DATA_Write written to the frame memory 233, . . . , and WLm is an $m^{th}$ line of the display data DATA_Write written to the frame memory 233. DL1 is a first line of the display data voltages V_display output by the scan driver 236, DL2 is a second line of the display data voltages V_display output by the scan driver 236, . . . , and DLm is an $m^{th}$ line of the display data voltages V_display output by the scan driver 236. Lines of the display data voltages V_display DL1, DL2, . . . , DLm are discriminated from each other by a horizontal blanking period (HBP). The display data voltages V_display of frames n FRAME, n+1 FRAME, etc., are discriminated from each other by a vertical blanking period (VBP).

However, referring to FIGS. 2A and 2B, because the display data DATA are sent and received in an asynchronous manner in the conventional asynchronous interface type, it is impossible to exactly predict when the display data DATA_Write will be written to the frame memory 233. In this case, it is impossible to reliably compare display data of a current frame with display data of a previous frame. Therefore, gray-level compensation processing technologies that essentially compare the display data of the current frame with the display data of the previous frame have not been applied to the conventional asynchronous interface type.

SUMMARY OF THE INVENTION

According to one aspect of the present invention, there is provided a display driver including a synchronization controller, a write clock detector, a frame memory, a gray-level compensator, and a selector. The synchronization controller sends a reference synchronization signal to a central processing unit (CPU) and controls the CPU to synchronize a write clock with the reference synchronization signal and to send the write clock. The write clock detector detects whether the write clock is received from the CPU and outputs a selection signal. The frame memory receives and stores display data of a current frame synchronized with the write clock. The gray-level compensator generates gray-level compensated display data based on the display data and display data of a previous frame previously stored in the frame memory. The selector outputs one of the gray-level compensated display data or the previously stored display data as scan data in response to the selection signal.

The selector may output the gray-level compensated display data as the scan data when the write clock is received, and the previously stored display data as the scan data when the write clock is not received.

The write clock detector may output the selection signal at a first logic level when the write clock is received and at a second logic level when the write clock is not received. Also, the selector may output the gray-level compensated display data as the scan data in response to the selection signal at the first logic level, and may output the previously stored display data as scan data in response to the selection signal at the second logic level.

The write clock detector may detect whether the write clock is included in a reference flag period of the reference synchronization signal. The write clock detector outputs the selection signal at a first logic level when the write clock is included in the reference flag period of the reference synchronization signal, and may output the selection signal at a second logic level when the write clock is not included in the reference flag period of the reference synchronization signal.

The display driver may further include a scan driver for outputting display data voltages corresponding to the scan data and a scan controller for synchronizing operations of the synchronization controller and the scan driver. The display data may be synchronized with the reference synchronization signal and written to the frame memory, and the display data voltages may be synchronized with the reference synchronization signal and output from the scan driver. Write timing of the display data and output timing of the display data voltages may be synchronized to avoid image tearing effects.

The scan driver may include a line buffer for receiving and storing the scan data, and an output buffer for outputting the display data voltages. When the display data are synchronized with the write clock and written to the frame memory, the write timing of the display data and the output timing of the display data voltages may have a timing difference of one line period.

The gray-level compensator may receive the display data of the current frame from the CPU, and the display data of the previous frame from the frame memory.

According to another aspect of the present invention, there is provided a display driving method of processing display data received from a CPU and outputting display data voltages. The method includes sending a reference synchronization signal to the CPU, detecting whether a write clock synchronized with the reference synchronization signal is received, and storing the display data synchronized with the write clock in a frame memory when the write clock is received. Gray-level compensated display data is generated based on the display data and previously stored display data of a previous frame. When the write clock is received, the gray-level compensated display data is output as scan data, and when the write clock is not received, the previously stored display data is output as the scan data. Display data voltages corresponding to the scan data is output.

Detecting whether the write clock is received may occur during a reference flag period of the reference synchronization signal. The method may further include outputting the gray-level compensated display data as the scan data when the write clock is received during the reference flag period of the reference synchronization signal, and outputting the previously stored display data as the scan data when the write clock is not received during the reference flag period of the reference synchronization signal.

In frames where the write clock is received, display data voltages generated based on the display data of a current frame synchronized with the write clock and the display data of the previous frame previously stored in the frame memory may be output as the display data voltages of the current frame. In frames where the write clock is not received, the display data voltages generated based on the display data of the previous frame previously stored in the frame memory may be output as the display data voltages of the current frame.

The method may further include synchronizing the display data with the reference synchronization signal and writing the display data to the frame memory, as well as synchronizing the display data voltages with the reference synchronization signal and outputting the display data voltages from a scan driver. Write timing of the display data and output timing of the display data voltages may be synchronized to avoid image tearing effects. When the display data are synchronized with the reference synchronization signal, the write timing of the display data and the output timing of the display data voltages may have a timing difference of one line period.

BRIEF DESCRIPTION OF THE DRAWINGS

The embodiments of the present invention will be described with reference to the attached drawings, in which.

DETAILED DESCRIPTION OF THE EMBODIMENTS

Figure 1A:
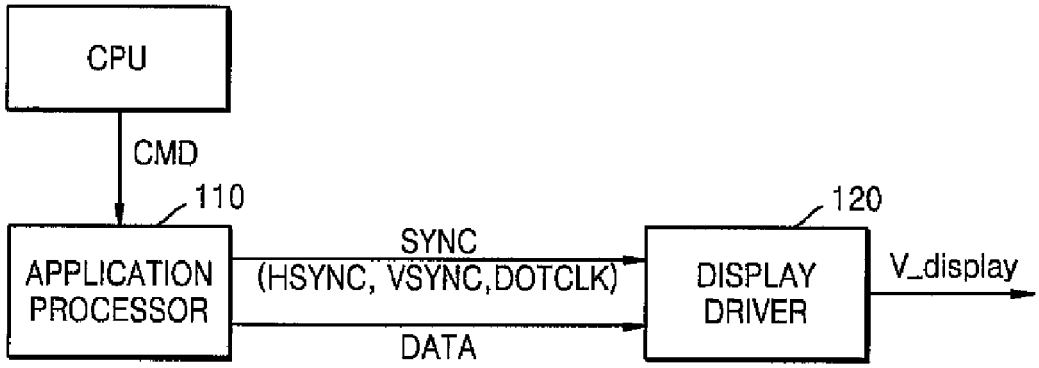
FIG. 1A (CONVENTIONAL ART)
FIG. 1A is a block diagram illustrating a conventional synchronous interface system.
Figure 1B:
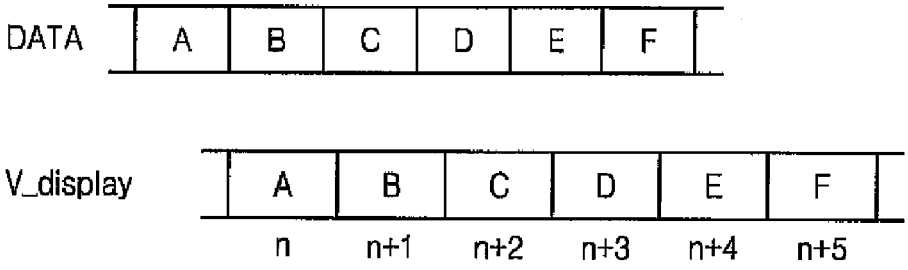
FIG. 1B (CONVENTIONAL ART)
FIG. 1B is a timing diagram illustrating display data and display data voltages of FIG. 1A.

The present invention will now be described more fully with reference to the accompanying drawings, in which exemplary embodiments of the invention are shown. The invention, however, may be embodied in various different forms, and should not be construed as being limited only to the illustrated embodiments. Rather, these embodiments are provided as examples, to convey the concept of the invention to one skilled in the art. Accordingly, known processes, elements, and techniques are not described with respect to some of the embodiments of the present invention. Throughout the drawings and written description, like reference numerals will be used to refer to like or similar elements.

Figure 3:
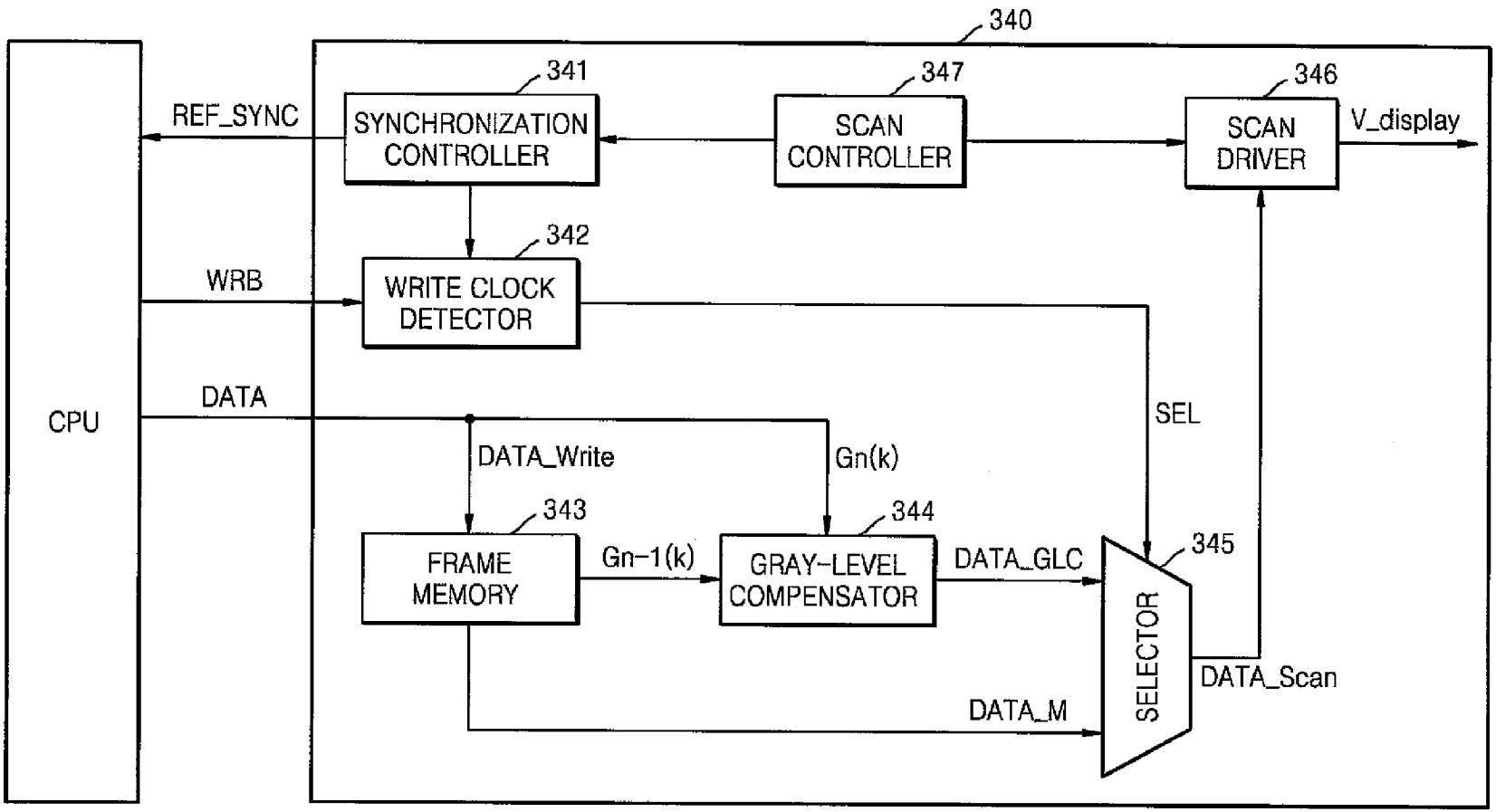
FIG. 3 is a block diagram illustrating a display driver, according to an exemplary embodiment of the present invention.

FIG. 3 is a block diagram of a display driver 340 according to an illustrative embodiment of the present invention. Referring to FIG. 3, a central processing unit (CPU) sends a write indicating signal WRB and display data DATA to the display driver 340. The display driver 340 includes a synchronization controller 341, a write clock detector 342, a frame memory 343, a gray-level compensator 344, a selector 345, a scan driver 346 and a scan controller 347. The synchronization controller 341 outputs a reference synchronization signal REF_SYNC. The write clock detector 342 detects a write clock (WCK illustrated in FIGS. 4A through 4C) included in the write indicating signal WRB received from the CPU and outputs a selection signal SEL. The frame memory 343 stores the display data DATA_Write received from the CPU. The gray-level compensator 344 receives display data Gn(k) of a current frame from the CPU and display data Gn−1(k) of a previous frame from the frame memory 343. The selector 345 receives gray-level compensated display data DATA_GLC from the gray-level compensator 344 and/or display data DATA_M stored in the frame memory 343. The scan driver 346 receives scan data DATA_Scan from the selector 345 and outputs display data voltages V_display.

Figure 4A:
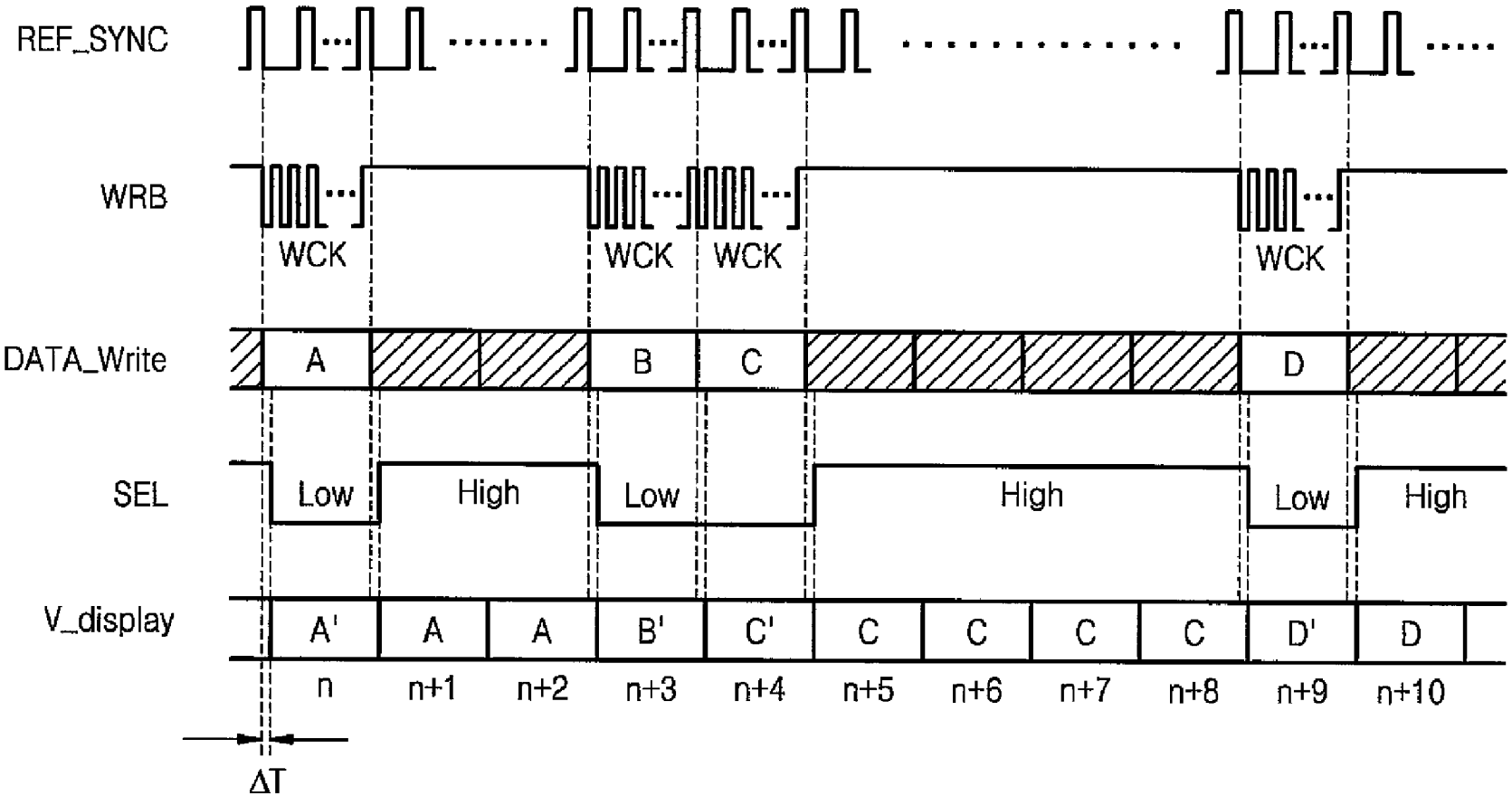
FIGS. 4A through 4C are timing diagrams illustrating signals, display data and display data voltages of FIG. 3, according to an exemplary embodiment of the present invention.
Figure 4B:
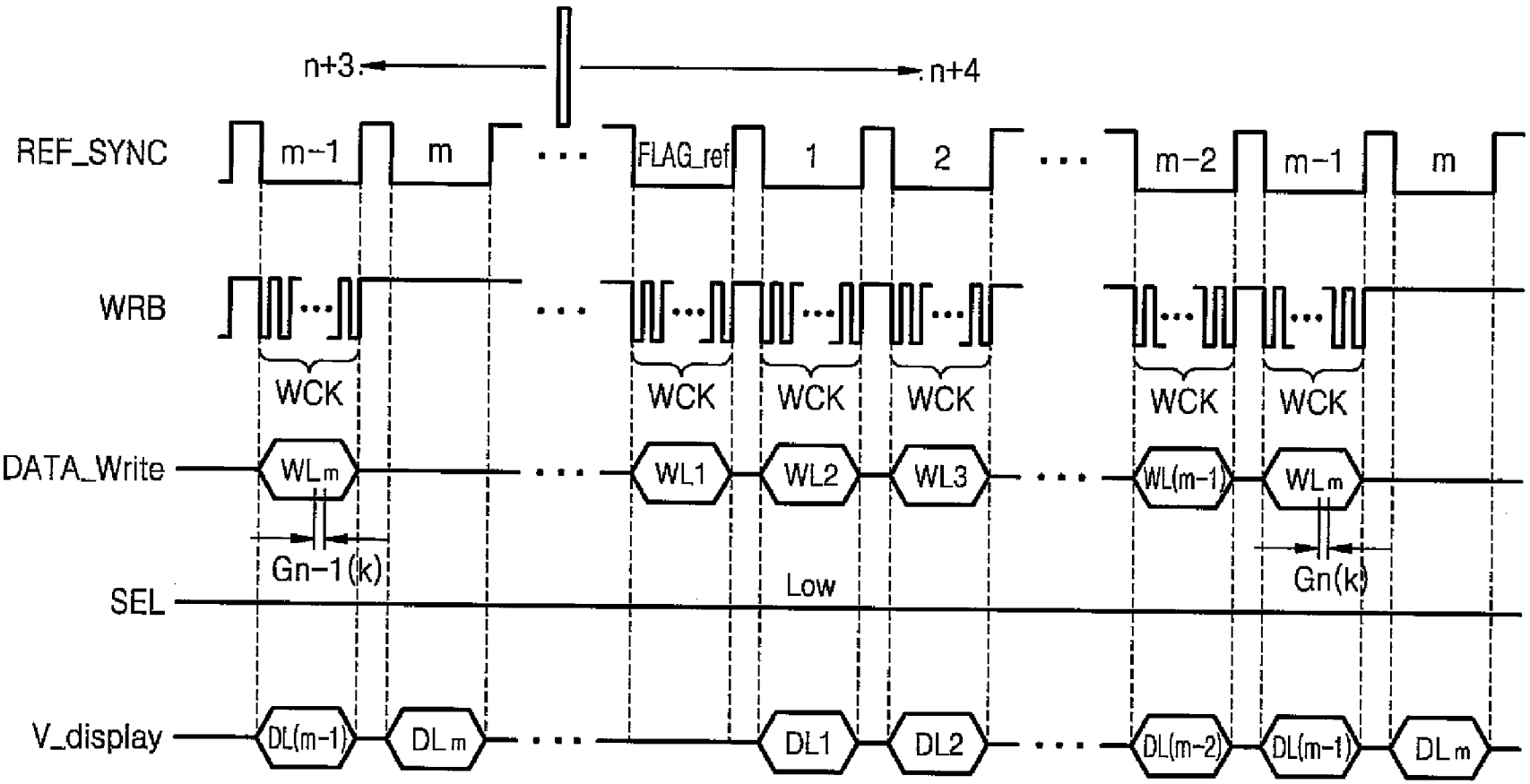
Figure 4C:
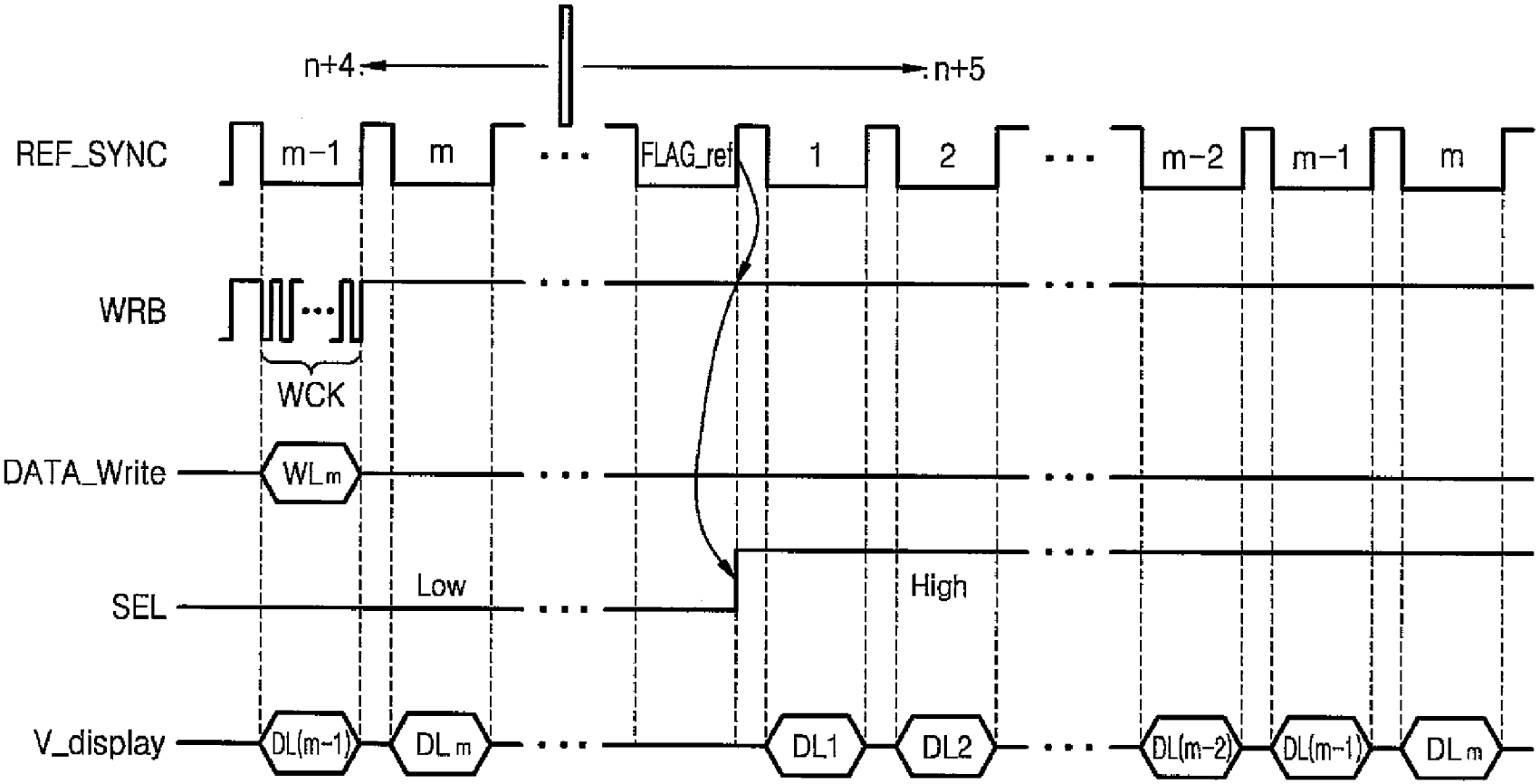

FIGS. 4A through 4C are timing diagrams of the reference synchronization signal REF_SYNC, the write indicating signal WRB, the display data DATA_Write (that is written to the frame memory 343), the selection signal SEL, and the display data voltages V_display illustrated in FIG. 3, according to an illustrative embodiment of the present invention. FIG. 4B, in particular, is a timing diagram of frame n+4 of FIG. 4A in which the write clock WCK is transmitted in a synchronous manner, and FIG. 4C is a timing diagram of frame n+5 of FIG. 4A in which the write clock WCK is not transmitted. An operation of the display driver 340 illustrated in FIG. 3 will now be described with reference to FIGS. 4A through 4C.

The synchronization controller 341 sends the reference synchronization signal REF_SYNC to the CPU and controls the CPU to synchronize the write clock WCK with the reference synchronization signal REF_SYNC and to sent the write clock WCK to the display driver 340. Unlike FIG. 2A, which shows the CPU sending the display data DATA to the display driver 230 in an asynchronous manner, the CPU of the present embodiment synchronizes the write clock WCK and the display data DATA with the reference synchronization signal REF_SYNC and sends the write clock WCK and the display data DATA to the display driver 340. Referring to FIG. 4B, each line of display data WL1, WL2, . . . , WLm is synchronized with the reference synchronization signal REF_SYNC and written to the frame memory 343.

Referring to FIG. 4A, in the frames n, n+3, n+4, and n+9, where the CPU transmits the write clock WCK to the display driver 340, the corresponding display data DATA_Write: A, B, C and D is written to the frame memory 343. Meanwhile, in the frames n+1, n+2, n+5 through n+8, and n+10, where the CPU does not transmit the write clock WCK to the display driver 340, the display data DATA are not transmitted to the display driver 340.

The write clock detector 342 detects whether the write clock WCK is transmitted from the CPU, and outputs a selection signal SEL corresponding to the detection results to the selector 345. For example, in FIGS. 4A through 4C, the write clock detector 342 outputs the selection signal SEL at a first logic level (e.g., a low level) when the write clock WCK is transmitted from the CPU, and outputs the selection signal SEL at a second logic level (e.g., a high level) when the write clock WCK is not transmitted from the CPU.

Referring to FIGS. 4B and 4C, the write clock detector 342 can detect whether the write clock WCK is sent in a reference flag period FLAG_ref of the reference synchronization signal REF_SYNC, for example. More particularly, when the write clock WCK is received during the reference flag period FLAG_ref, it can be considered that the write clock WCK is likewise received during the corresponding frame. When the write clock WCK is not received during the reference flag period FLAG_ref, it can be considered that the write clock WCK is likewise not received during the corresponding frame.

Therefore, the write clock detector 342 outputs the selection signal SEL at the first logic level when the write clock WCK is received in the reference flag period FLAG_ref, and outputs the selection signal SEL at the second logic level when the write clock WCK is not received in the reference flag period FLAG_ref. Referring to FIG. 4A, the write clock detector 342 outputs the selection signal SEL at different logic levels according to whether the write clock WCK is sent. For example, referring to FIG. 4C, when the write clock WCK is in the reference flag period FLAG_ref of the $n+4^{th}$ frame, and the write clock WCK is not in the reference flag period FLAG_ref of the $n+5^{th}$ frame, the write clock detector 342 outputs the selection signal SEL at the first logic level (e.g., the low level) before the reference flag period FLAG_ref of the $n+5^{th}$ frame, and outputs the selection signal SEL at the second logic level (e.g., the high level) after the reference flag period FLAG_ref of the $n+5^{th}$ frame.

The gray-level compensator 344 generates the gray-level compensated display data DATA_GLC based on the display data Gn−1(k) of a previous frame and the display data Gn(k) of a current frame. The gray-level compensator 344 receives the display data Gn−1(k) of the previous frame from the frame memory 343 and the display data Gn(k) of the current frame from the CPU. Referring to FIG. 4B, Gn−1(k) denotes display data of a specific pixel of the n+3 frame, and Gn(k) denotes display data of a specific pixel of the n+4 frame.

The selector 345 outputs the gray-level compensated display data DATA_GLC or the display data DATA_M stored in the frame memory 343 as the scan data DATA_Scan in response to the selection signal SEL received from the write clock detector 342. More particularly, the selector 345 can output the gray-level compensated display data DATA_GLC in response to the selection signal SEL at the first logic level (e.g., the low level), and the display data DATA_M stored in the frame memory 343 in response to the selection signal SEL at the second logic level (e.g., the high level) as the scan data DATA_Scan. The display data DATA_M is the display data previously stored in the frame memory 343 and is not gray-level compensated, but may be output as the scan data DATA_Scan.

Accordingly, when the write clock WCK is transmitted, the gray-level compensated display data DATA_GLC is output as the scan data DATA_Scan, and when the write clock WCK is not transmitted, the display data DATA_M stored in the frame memory 343 is output as the scan data DATA_Scan. That is, gray-level compensation is selectively performed according to whether the display data DATA_Write is synchronized with the reference synchronization signal REF_SYNC and written to the frame memory 343. In an embodiment, when the write clock WCK is not transmitted, the gray-level compensator 344 can be powered off in order to reduce power consumption. For example, although not shown in FIG. 3, the gray-level compensator 344 can be selectively powered on/off in response to the selection signal SEL or according to whether the display data Gn(k) of a current frame is input into the gray-level compensator 344.

The scan driver 346 outputs the display data voltages V_display corresponding to the scan data DATA_Scan received from the selector 345. Although not shown in FIG. 3, the scan driver 346 may include a line buffer that receives and stores the scan data DATA_Scan, and an output buffer that outputs the display data voltages V_display.

In the frames where the CPU sends the write clock WCK to the display driver 340, the gray-level compensated display data DATA_GLC is input into the scan driver 346 as the scan data DATA_Scan. In this case, the scan driver 346 outputs display data voltages generated based on display data Gn(k) of a current frame synchronized with the write clock WCK and display data Gn−1(k) of a previous frame previously stored in the frame memory 343 as the display data voltages V_display of the current frame. For example, referring to FIG. 4A, in frame n+9, scan data D' is generated based on display data D of a current frame (the $n+9^{th}$ frame) synchronized with the write clock WCK and display data C of a previous frame (the $n+8^{th}$ frame) previously stored in the frame memory 343, and the display data voltages corresponding to the scan data D' are output as the display data voltages V_display of the current frame. Of course, scan data A' of frame n, scan data B' of frame n+3, and scan data C' of frame n+4 are determined similarly as described above with respect to the scan data D'.

In the frames where the CPU does not send the write clock WCK to the display driver 340, the display data DATA_M stored in the frame memory 343 is input into the scan driver 346 as the scan data DATA_Scan. In this case, the scan driver 346 outputs display data voltages generated based on display data Gn−1(k) of a previous frame that was previously stored in the frame memory 343 as the display data voltages V_display of a current frame. For example, referring to FIG. 4A, in frame n+8, display data C of a previous frame (e.g., the $n+7^{th}$ frame) previously stored in the frame memory 343 is input into the scan driver 346 as the scan data DATA_Scan of a current frame (e.g., the $n+8^{th}$ frame), and display data voltages corresponding to the scan data C are output as the display data voltages V_display of the current frame. Of course, scan data A of frames n+1 and n+2, scan data C of frames n+5 through n+7, and scan data D of frame n+10 are determined similarly as described above with respect to the scan data C.

The scan controller 347 synchronizes the operation of the synchronization controller 341 and the operation of the scan driver 346, and controls the synchronization controller 341 and the scan driver 346. For example, in the depicted embodiment, the display data DATA_Write is synchronized with the reference synchronization signal REF_SYNC and written to the frame memory 343, and the display data voltages V_display is synchronized with the reference synchronization signal REF_SYNC and output from the scan driver 346. Write timing of the display data DATA_Write and output timing of the display data voltages V_display are synchronized with the reference synchronization signal REF_SYNC, thereby avoiding image tearing effects.

Image tearing effects appear when two different frame images are simultaneously displayed on a frame screen due to discrepancies between write frequencies of the display data DATA_Write and output frequencies of the display data voltages V_display (e.g., discrepancies between memory write frequencies of the display data DATA_Write and screen scan frequencies of the display data voltages V_display). In the present embodiment, since memory write timing of the display data DATA_Write and screen scan timing of the display data voltages V_display are synchronized with the reference synchronization signal REF_SYNC, image tearing effects are prevented from appearing on a screen.

Figure 2A:
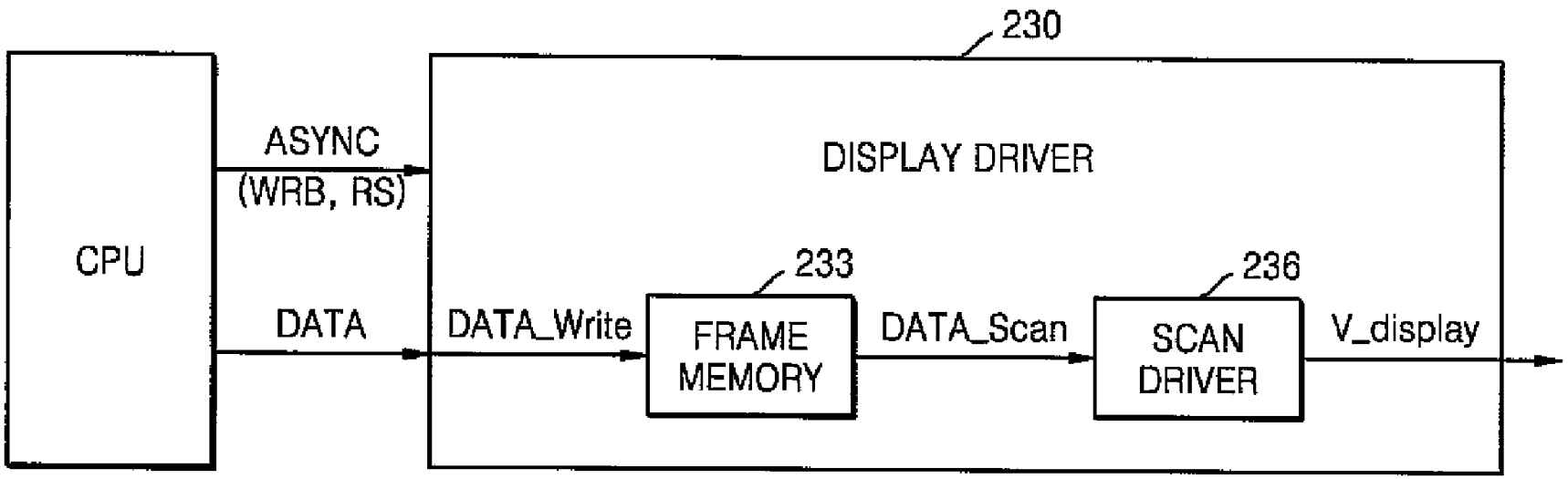
FIG. 2A (CONVENTIONAL ART)
FIG. 2A is a block diagram illustrating a conventional asynchronous interface system.
Figure 2B:
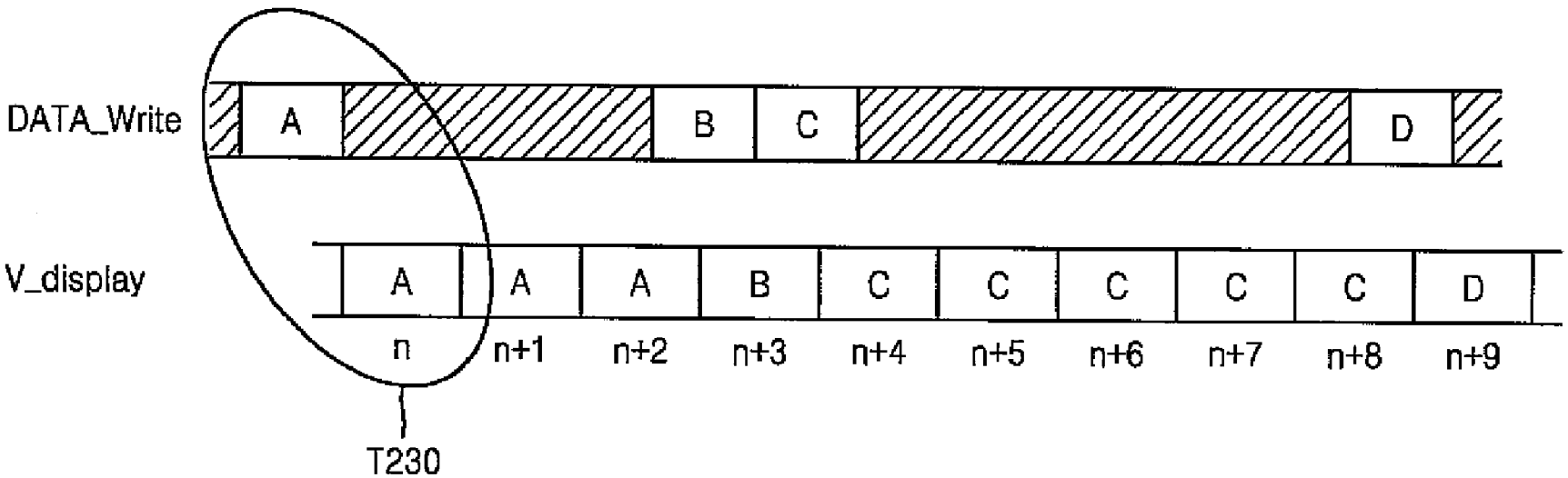
FIG. 2B (CONVENTIONAL ART)
FIG. 2B is a timing diagram illustrating display data and display data voltages of FIG. 2A.
Figure 2C:
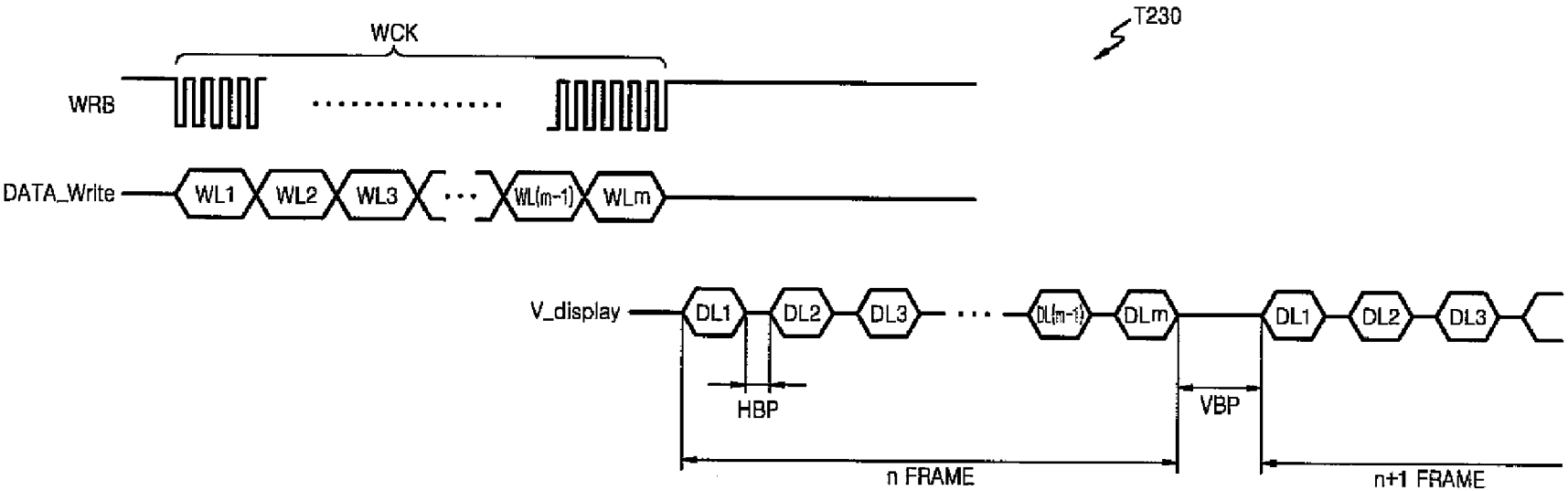
FIG. 2C (CONVENTIONAL ART)
FIG. 2C is a timing diagram illustrating a signals, display data and display data voltages of FIG. 2A.

In the conventional asynchronous interface type illustrated in FIGS. 2A and 2B, the display data DATA_Write: A, B, C and D are randomly transmitted to the display driver 230 without timing limitations. In the illustrative embodiment described above, the write clock WCK and the display data DATA are synchronized with the reference synchronization signal REF_SYNC and the synchronized write clock WCK and the display data DATA are transmitted to the display driver 340. Because the write clock WCK and the display data DATA are to be synchronized with the reference synchronization signal REF_SYNC, the timing of the CPU is limited.

Referring again to FIG. 4A, ΔT denotes a timing difference between write timing of the display data DATA_Write and output timing of the display data voltages V_display. Referring to FIG. 4B, the write timing of the display data DATA_Write and the output timing of the display data voltages V_display have a timing difference of one line period, for example. More particularly, the memory write timing of each line of display data WL1, WL2, WL3, . . . , WL(m−1), WLm, and the screen scan timing of each line of display data voltages DL1, DL2, . . . , DL(m−2), DL(m−1), DLm, have one line timing difference. The line period of timing may be used to process data, such as gray-level compensation, for example. A frame may further include the reference flag period FLAG-ref, in addition to the line periods 1, 2, , , , m−2, m−1, m, in order to maintain the timing difference of one line period.

When the write timing of the display data DATA_Write and the output timing of the display data voltages V_display have a timing difference of two lines, the scan driver 346 needs two line buffers. When the write timing of the display data DATA_Write and the output timing of the display data voltages V_display have a timing difference of three lines, the scan driver 346 needs three line buffers. Likewise, when the write timing of the display data DATA_Write and the output timing of the display data voltages V_display have a timing difference of m lines, the scan driver 346 needs m line buffers. However, as discussed above, when the write timing of the display data DATA_Write and the output timing of the display data voltages V_display have a timing difference of one line period, it is sufficient for the scan driver 346 to have one line buffer.

A display driving method according to an embodiment of the present invention will now be described. The display driving method of processing the display data DATA received from the CPU and outputting display data voltages V_display includes the following operations.

The reference synchronization signal REF_SYNC is sent to the CPU. It is detected whether the write clock WCK synchronized with the reference synchronization signal REF_ SYNC is received from the CPU. The display data DATA that is synchronized with the write clock WCK is written to the frame memory 343. The display data DATA_ GLC that is gray-level compensated based on display data Gn−1(k) of a previous frame and display data Gn(k) of a current frame is generated.

When the write clock WCK is received, the gray-level compensated display data DATA_GLC is output as the scan data DATA_Scan. When the write clock WCK is not received, the display data DATA_M stored in the frame memory 343 is output as the scan data DATA_Scan.

In an embodiment, as described above, it is detected whether the write clock WCL is in the reference flag period FLAG_ref of the reference synchronization signal REF_ SYNC to determine whether to output the gray-level compensated display data DATA_GLC or the display data DATA_M stored in the frame memory 343 as the scan data DATA_Scan. More particularly, when the write clock WCL is included in the reference flag period FLAG_ref, the gray-level compensated display data DATA_GLC is output as the scan data DATA_Scan. When the write clock WCK is not included in the reference flag period FLAG_ref, the display data DATA_M stored in the frame memory 343 is output as the scan data DATA_Scan.

The display data voltages V_display corresponding to the scan data DATA_Scan is output. When the display data DATA_Write is synchronized with the write clock WCK and is written to the frame memory 343, the write timing of the display data DATA_Write and the output timing of the display data voltages V_display have a timing difference of one line period, as described above.

In the frames n, n+3, n+4, and n+9 of FIG. 4A, where the CPU sends the write clock WCK to the display driver 340, display data voltages generated based on display data of a current frame synchronized with the write clock WCK and display data of a previous frame previously stored in the frame memory 343 are output as display data voltages V_display of the current frame. In the frames n+1, n+2, n+5 through n+8, and n+10 of FIG. 4A, where the CPU does not send the write clock WCK to the display driver 340, display data voltages generated based on display data of a previous frame previously stored in the frame memory 343 are output as display data voltages V_display of a current frame.

The display data DATA_Write is synchronized with the reference synchronization signal REF_SYNC and is written to the frame memory 343. The display data voltages V_display are synchronized with the reference synchronization signal REF_SYNC and are output from the scan driver 346. The write timing of the display data DATA_Write and the output timing of the display data voltages V_display are synchronized with the reference synchronization signal REF_ SYNC, thereby improving image quality, for example, by avoiding image tearing effects.

Embodiments of the present invention provide a display device and a display driving method that selectively process gray-level compensation in an asynchronous interface type. According to these embodiments, gray-level compensation can be selectively processed in an asynchronous interface type, thereby improving video quality.

While the present invention has been described with reference to exemplary embodiments, it will be apparent to those skilled in the art that various changes and modifications may be made without departing from the spirit and scope of the present invention. Therefore, it should be understood that the above embodiments are not limiting, but illustrative.

What is claimed is:

1. A display driver comprising:

a synchronization controller for sending a reference synchronization signal to a central processing unit (CPU) and for controlling the CPU to synchronize a write clock with the reference synchronization signal and to send the write clock;

a write clock detector for detecting whether the write clock is received from the CPU and for outputting a selection signal indicative of whether the write clock is received from the CPU;

a frame memory for receiving and storing display data sent from the CPU and synchronized with the write clock;

a gray-level compensator for generating gray-level compensated display data based on display data of a current frame and display data of a previous frame previously stored in the frame memory; and a selector for outputting the gray-level compensated display data as scan data when the selection signal indicates that the write clock signal is received from the CPU, and for outputting the display data previously stored in the frame memory as scan data when the selection signal indicates that the write clock signal is not received from the CPU.

2. The display driver of claim 1, wherein the write clock detector outputs the selection signal at a first logic level when the write clock is received, and outputs the selection signal at a second logic level when the write clock is not received.

3. The display driver of claim 2, wherein the selector outputs the gray-level compensated display data as the scan data in response to the selection signal at the first logic level, and outputs the display data previously stored in the frame memory as the scan data in response to the selection signal at the second logic level.

4. The display driver of claim 1, wherein the write clock detector detects whether the write clock is received during a reference flag period of the reference synchronization signal.

5. The display driver of claim 4, wherein the write clock detector outputs the selection signal at a first logic level when the write clock is received during the reference flag period of the reference synchronization signal, and outputs the selection signal at a second logic level when the write clock is not received during the reference flag period of the reference synchronization signal.

6. The display driver of claim 1, further comprising:

a scan driver for outputting display data voltages corresponding to the scan data.

7. The display driver of claim 6, further comprising:

a scan controller for synchronizing operations of the synchronization controller and the scan driver.

8. The display driver of claim 7, wherein the display data are synchronized with the reference synchronization signal and written to the frame memory, and the display data voltages are synchronized with the reference synchronization signal and output from the scan driver.

9. The display driver of claim 8, wherein write timing of the display data and output timing of the display data voltages are synchronized to avoid image tearing effects.

10. The display driver of claim 6, wherein the scan driver comprises:

a line buffer for receiving and storing the scan data; and an output buffer for outputting the display data voltages.

11. The display driver of claim 10, wherein when the display data are synchronized with the write clock and written to the frame memory, the write timing of the display data and the output timing of the display data voltages have a timing difference of one line period.

12. The display driver of claim 1, wherein the gray-level compensator receives the display data of the current frame from the CPU without first being stored in the frame memory, and the display data of the previous frame from the frame memory.

13. A display driving method of processing display data received from a central processing unit (CPU) and outputting display data voltages, the method comprising:

sending a reference synchronization signal to the CPU;

detecting whether a write clock, synchronized with the reference synchronization signal, is received;

storing the display data sent from the CPU and synchronized with the write clock in a frame memory;

generating gray-level compensated display data based on display data of a current frame and display data of a previous frame previously stored in the frame memory;

when the write clock is received, outputting the gray-level compensated display data as scan data, and when the write clock is not received, outputting the display data previously stored in the frame memory as the scan data; and outputting display data voltages corresponding to the scan data.

14. The method of claim 13, wherein detecting whether the write clock is received is performed during a reference flag period of the reference synchronization signal.

15. The method of claim 14, further comprising:

outputting the gray-level compensated display data as the scan data when the write clock is received during the reference flag period of the reference synchronization signal; and outputting the display data previously stored in the frame memory as the scan data when the write clock is not received during the reference flag period of the reference synchronization signal.

16. The method of claim 13, wherein, in frames where the write clock is received, display data voltages generated based on the display data of a current frame and the display data of the previous frame previously stored in the frame memory are output as the display data voltages of the current frame, and in frames where the write clock is not received, display data voltages generated based on the display data of the previous frame previously stored in the frame memory are output as the display data voltages of the current frame.

17. The method of claim 13, wherein:

the display data sent from the CPU is synchronized with the reference synchronization signal and is written to the frame memory; and the display data voltages are synchronized with the reference synchronization signal and are output from a scan driver.

18. The method of claim 17, wherein write timing of the display data and output timing of the display data voltages are synchronized to avoid image tearing effects.

19. The method of claim 18, wherein when the display data is synchronized with the write clock and is written to the frame memory, the write timing of the display data and the output timing of the display data voltages have a timing difference of one line period.

* * * * *